US009938770B2

(12) United States Patent
Lundgren

(10) Patent No.: US 9,938,770 B2
(45) Date of Patent: Apr. 10, 2018

(54) SLIDE VALVE, PERCUSSION DEVICE AND METHOD

(71) Applicant: CONSTRUCTION TOOLS PC AB, Kalmar (SE)

(72) Inventor: Anders Lundgren, Degerhamn (SE)

(73) Assignee: CONSTRUCTION TOOLS PC AB, Kalmar (SE)

( * ) Notice: Subject to any disclaimer, the term of this patent is extended or adjusted under 35 U.S.C. 154(b) by 287 days.

(21) Appl. No.: 14/378,891

(22) PCT Filed: Feb. 11, 2013

(86) PCT No.: PCT/SE2013/050112

§ 371 (c)(1),
(2) Date: Aug. 14, 2014

(87) PCT Pub. No.: WO2013/122534

PCT Pub. Date: Aug. 22, 2013

(65) Prior Publication Data

US 2015/0083501 A1 Mar. 26, 2015

(30) Foreign Application Priority Data

Feb. 17, 2012 (SE) ..... 1250136

(51) Int. Cl.
*B25D 9/20* (2006.01)
*E21B 1/02* (2006.01)
(Continued)

(52) U.S. Cl.
CPC ..... *E21B 1/02* (2013.01); *B25D 9/08* (2013.01); *B25D 9/20* (2013.01); *E21B 7/025* (2013.01); *B25D 2250/351* (2013.01)

(58) Field of Classification Search
CPC ..... E21D 20/003; F02B 63/02; B25D 9/16; B25D 17/04; B25D 9/12; B25D 9/145;
(Continued)

(56) References Cited

U.S. PATENT DOCUMENTS 1,554,984 A 9/1925 Bayles
1,569,542 A * 1/1926 Gartin ..... E21B 19/086 173/158
(Continued)

FOREIGN PATENT DOCUMENTS

EP 0335994 A1 10/1989

OTHER PUBLICATIONS

PCT/ISA/210—International Search Report—dated May 29, 2013 (Issued in PCT/SE2013/050112).
(Continued)

*Primary Examiner* — Kipp C Wallace
(74) *Attorney, Agent, or Firm* — Venable LLP; Jeffri A. Kaminski

(57) ABSTRACT

A slide valve for a hydraulic percussion device. The slide valve includes a transition surface that is arranged to alternately be subjected to a working pressure and a tank pressure to carry out a reciprocating movement when the percussion device is in use. The slide valve includes at least one channel that is open at one end of the slide valve, and at least one displaceable pin that is arranged inside the at least one channel.

15 Claims, 2 Drawing Sheets

(51) Int. Cl.
*B25D 9/08* (2006.01)
*E21B 7/02* (2006.01)

(58) Field of Classification Search
CPC ... B25D 9/18; B25D 9/20; B25D 9/26; B25D 2209/005; B25D 2209/007; E21B 19/086; E21B 19/087; F01L 25/04; F01L 17/00
See application file for complete search history.

(56) References Cited

U.S. PATENT DOCUMENTS 1,662,791 A * 3/1928 Gartin ..... E21B 19/086 173/161
1,761,734 A * 6/1930 Maximilian ..... B25D 9/20 173/135
1,808,481 A * 6/1931 Slater ..... B25D 9/16 173/170
2,165,904 A * 7/1939 Osgood ..... E21B 19/086 173/157
2,617,629 A * 11/1952 Robinson ..... E21B 19/087 173/170
2,748,751 A * 6/1956 Johnson ..... E02D 7/10 173/112
3,011,569 A * 12/1961 Dick ..... E21B 19/087 173/158
3,132,703 A * 5/1964 Larcen ..... E21B 19/087 173/158
3,191,692 A * 6/1965 Ekwall ..... B25D 9/16 137/530
3,203,489 A * 8/1965 Fuehrer ..... E21B 19/087 173/158
4,005,637 A * 2/1977 Bouyoucos ..... B25D 9/12 91/276
4,142,447 A 3/1979 Krasnoff et al.
4,286,929 A * 9/1981 Heath ..... F01B 11/001 417/404
4,624,325 A * 11/1986 Steiner ..... F16F 9/516 173/133
6,073,706 A * 6/2000 Niemi ..... B25D 9/18 173/138
6,176,016 B1 * 1/2001 Higashi ..... A01D 34/90 30/276
6,273,199 B1 * 8/2001 Kiikka ..... B25D 9/12 173/1
6,581,568 B2 * 6/2003 Kramer ..... A01D 34/90 123/179.18
6,752,221 B1 * 6/2004 Morissette ..... B25D 17/28 173/193
9,375,832 B2 * 6/2016 Boeck ..... B25F 5/00
2006/0213690 A1 * 9/2006 Muuttonen ..... B25D 9/18 175/296

OTHER PUBLICATIONS

PCT/ISA/237—Written Opinion of the International Searching Authority—dated May 29, 2013 (Issued in PCT/SE2013/050112).

* cited by examiner

SLIDE VALVE, PERCUSSION DEVICE AND METHOD

TECHNICAL FIELD

The present invention concerns a slide valve for a hydraulic percussion device, and a hydraulic percussion device that contains such a slide valve. The present invention also concerns a method for making a slide valve of a percussion device carry out a reciprocating movement when the percussion device is in use

BACKGROUND OF THE INVENTION

Percussion devices often comprise a linearly working percussion piston that is controlled by a slide valve. Usually the slide valve is controlled by a signal channel whose pressure varies. Either a tank pressure or full working pressure acts upon the transition surface of the slide valve via the signal channel.

Usually the seal between the pressure channel and the tank channel consists of only a radial column seal where there will always be some play, and which can give rise to leakage and decreased efficiency. The slide valve can also drift during the percussion piston's displacement and provide an even shorter column seal length.

U.S. Pat. No. 4,142,447 discloses a percussion device that comprises a slide valve and a plurality of pins that are arranged in a machine housing to press against an upper end of the slide valve and thereby hold the slide valve in place in its lowermost turning location. The upper end of the pins is subjected to the pressure in a pressure chamber that is arranged inside the machine housing.

SUMMARY OF THE INVENTION

An object of the present invention is to provide an improved slide valve for a hydraulic percussion device.

This object is achieved by a slide valve that comprises a transition surface that is arranged to be alternately subjected to a working pressure and a tank pressure, i.e. a higher pressure and a lower pressure, to carry out a reciprocating movement when the percussion device is in use. The slide valve is for example arranged to control a percussion piston of the percussion device, which percussion piston is arranged to carry out a reciprocating movement caused by the pressure from a hydraulfluid, i.e. a hydraulic fluid or gas.

The slide valve comprises at least one channel, i.e. one channel or several separate or connected channels that are open at one end of the slide valve, and at least one displaceable pin, i.e. one or more separate or connected pins that are at least partly arranged inside the at least one channel.

According to an embodiment of the invention the pins are arranged to be subjected to a working pressure that presses one end of the pins against a non-moveable component of said hydraulic percussion device, i.e. a component that is not arranged to be displaced when the percussion device is in use, which provides a force in the corresponding direction on the slide valve. The component can for example be part of the machine housing or accumulator housing.

Such a slide valve provides a better holding force since one pin or a plurality of pins holds the slide valve stably in place when the slide valve is mounted in a percussion device and the percussion device is in use. The slide valve has, for example, flat surfaces at each end, which axially seal against corresponding surfaces in the machine housing. Since the pins are at least partly arranged in the slide valve itself, and not in the machine housing, as in U.S. Pat. No. 4,142,447, a more compact solution is achieved.

The word "pin" as used in this document does not necessarily mean a narrow rectangular component having the same cross section along its entire length, but can also refer to a component that can have any shape and a uniform or non-uniform cross section along its length.

According to another embodiment of the invention the working pressure is a substantially constant pressure, such as the percussion device's working pressure.

According to a further embodiment of the invention the working pressure is achieved using a hydraulic fluid. Alternatively, or additionally, the working pressure is achieved using resilient material, such as a spring.

According to an embodiment of the invention the slide valve is arranged to be displaced between two end locations when the percussion device is in use, and said at least one pin is arranged to press the slide valve against a non-moveable component of the hydraulic percussion device, such as a machine housing, to provide an end seal between said slide valve and said non-movable component at both end locations.

According to an embodiment of the invention the slide valve constitutes a cylindrical sleeve.

According to another embodiment of the invention the slide valve has a plurality of different diameters, such as two or three different diameters so as to achieve a good force balance on the slide valve.

According to an embodiment of the invention a surface of said slide valve is arranged to be subjected to tank pressure when the percussion device is in use.

According to another embodiment of the invention said at least one channel extends in the slide valve's axial direction when the slide valve is mounted in a hydraulic percussion device. According to an embodiment of the invention the channel/channels extend(s) along at least 20%, or at least 50%, preferably at least 60%, more preferably at least 70%, even more preferably at least 80% or more of the slide valve's length.

According to an embodiment of the invention said at least one channel is in fluid communication with a hydraulic fluid via at least one conduit that is arranged to extend in the slide valve's radial direction when the slide valve is mounted in a hydraulic percussion device. The conduits that connect said at least one channel with the hydraulic fluid can therefore be arranged to be very short, i.e. a few millimeters long.

According to another embodiment of the invention the slide valve contains a plurality of channels that are uniformly distributed around its periphery/perimeter, for example symmetrically around a percussion piston if the slide valve is arranged radially outwards from, and around a percussion piston.

According to further embodiment of the invention the outer diameter of a pin corresponds to the inner diameter of a channel. The pins thereby constitute a seal between the working pressure channel and the tank pressure channel because very little, if any hydraulic fluid can flow past the pins. It should be noted that the word "diameter" as used in this document does not mean that a component is necessarily circular, but the word "diameter" also refers to the largest transverse dimension of a component.

The present invention also concerns a percussion device that contains a slide valve according to an embodiment of the invention.

According to another embodiment of the invention the slide valve is arranged to be used at a frequency of at least 10 Hz, or at least 50 Hz, preferably at least 60 Hz, more preferably at least 70 Hz, even more preferably at least 80 Hz or higher.

The present invention also concerns a method for making a slide valve of a percussion device, for example a slide valve according to an embodiment of the invention, carry out a reciprocating movement when said percussion device is in use. The method comprises the step of alternately subjecting a transition surface of the slide valve to a working pressure and a tank pressure. The slide valve is arranged with at least one channel that is open at one end of said slide valve, and at least one displaceable pin is arranged at least partly arranged inside said at least one channel.

According to an embodiment of the invention said at least one pin is subjected to a working pressure that presses an end of a pin against a non-moveable component of said hydraulic percussion device.

According to another embodiment of the invention said working pressure is a substantially constant pressure, such as the percussion device's working pressure. Said working pressure can be achieved using a hydraulic fluid and/or a spring.

BRIEF DESCRIPTION OF THE DRAWINGS

In the following, the present invention will be described in more detail with reference to the accompanying schematic figures in which.

It should be noted that the drawings have not necessarily been drawn to scale and that the dimensions of certain features may have been exaggerated for the sake of clarity.

DETAILED DESCRIPTION OF EMBODIMENTS

Figure 1:
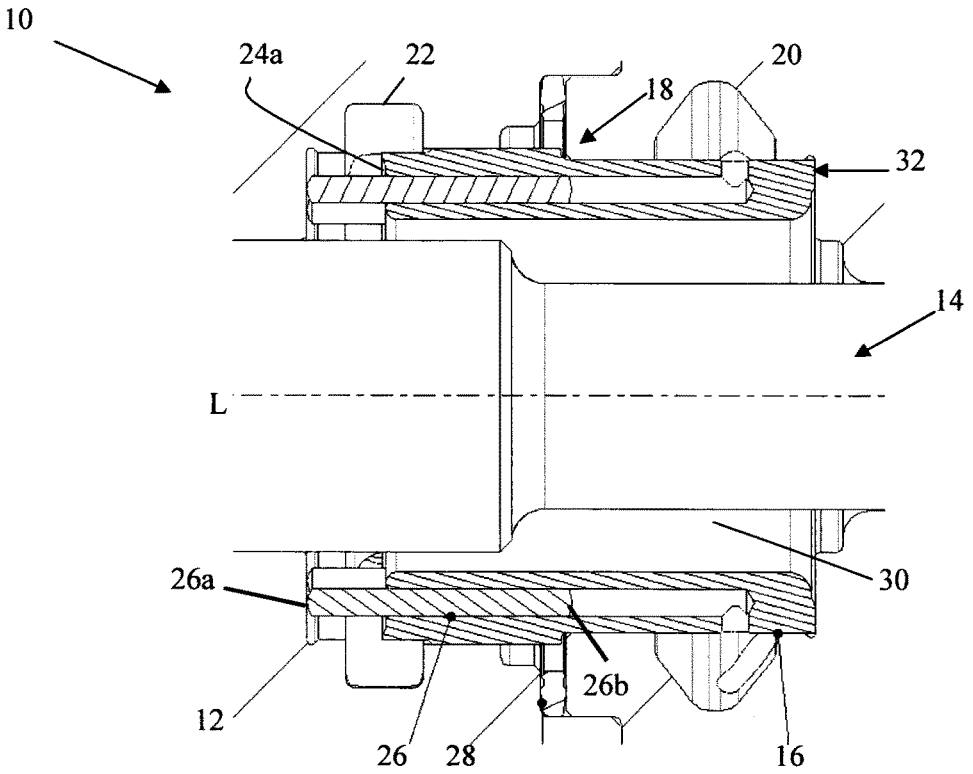
FIGS. 1 & 2 show part of a percussion device according to an embodiment of the present invention.

FIG. 1 shows part of a hydraulic fluid-driven percussion device 10 according to an embodiment of the present invention. The percussion device 10 comprises a machine housing 12 that contains a percussion piston 14. The percussion piston 14 is arranged to carry out a reciprocating movement, for example at a frequency of 10 Hz or higher, along its longitudinal axis L when the percussion device 10 is in use.

The percussion device 10 comprises a cylindrical slide valve 16 that comprises a transition surface 18 that is arranged to be alternately subjected to the percussion device's working pressure 20 and tank pressure 22 via a signal channel 28. The slide valve 16 comprises a plurality of channels 24 uniformly distributed around the slide valve's 16 periphery, which channels 24 extend along about 80% of the slide valve's 16 length. The channels 24 can for example be 20-50 mm long, preferably 25-40 mm long. The channels 24 are open at one end 24*a* of the slide valve 16 and extend in the slide valve's axial direction L at an angle of 90° from the slide valve's end 24*a*. A number of pins 26 is arranged inside the channels 24, one in each channel 24. The pins 26 are displaceable and are arranged to extend out of the slide valve 16 in the illustrated embodiment.

One end 26*b* of each pin 26 is subjected to a substantially constant working pressure, for example the percussion device's working pressure 20, in order to press the opposite end 26*a* of the pin 26 against a non-moveable component 12 of the hydraulic percussion device 10, which provides a force in the corresponding direction on the slide valve 16. Alternatively the pins 26 can be spring loaded to hold the slide valve 16 in place in its end locations.

In FIG. 1 the slide valve 16 is shown in its upper end location (displaced towards the right hand side in FIG. 1). The percussion piston's 14 upper percussion space 30 is in fluid communication with the tank channel 22. The working pressure channel 20 is in fluid communication with the upper end 26*b* of the pins but is sealed from the percussion piston's upper percussion space 30 by the slide valve 16. The pins 26, an end 26*a* of which is pressed against the machine housing 12 and provides a seal between the machine housing 12 and the slide valve 16, hold the slide valve 16 in place in its upper end location. The resulting force from the pins 26 on the slide valve 16 presses the slide valve 16 against the machine housing 12 and provides an axial end seal between the slide valve 16 and the machine housing 12. The end seal surfaces 32 have been indicated in FIGS. 1-3.

Figure 2:
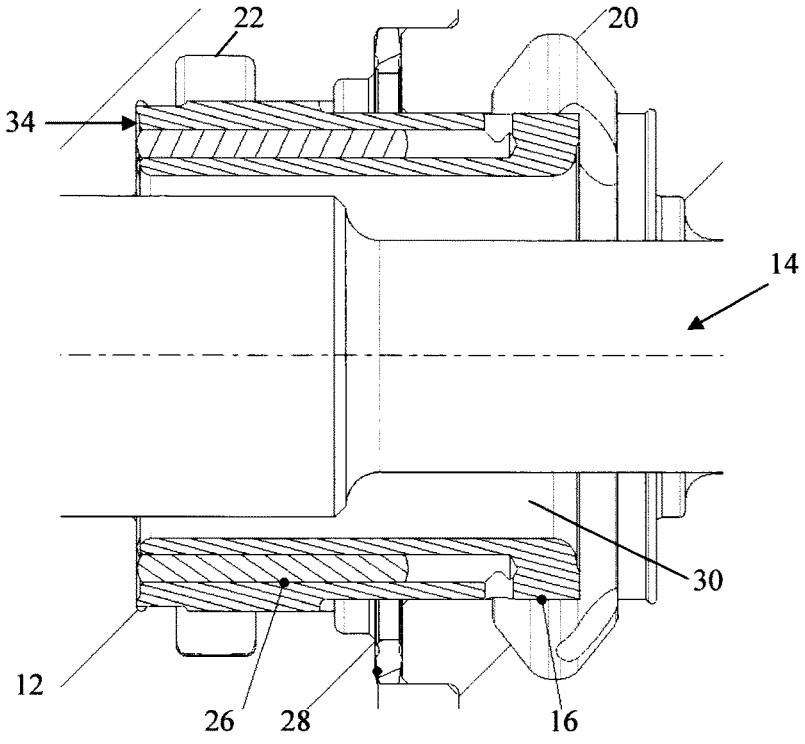

The transition surface 18 of the slide valve 16 is arranged to be bigger than the total surface of the pins 26 so that when the slide valve's transition surface 18 is subjected to a working pressure 20 from the signal channel 28, the slide valve 16 is displaced to its lower end location (towards the left hand side as shown in FIG. 2). When the slide valve's transition surface 18 is subjected to a tank pressure 22 from the signal channel 28, the slide valve 16 is again displaced to its upper end location (towards the right hand side as shown in FIG. 1).

In FIG. 2 the slide valve 16 is shown in its lower end location (displaced towards the left hand side in FIG. 2) against the machine housing 12. The percussion piston's 14 upper percussion space 30 is in fluid communication with a working pressure 20. The working pressure channel 20 is also in fluid communication with the upper end 26*b* of the pins and presses an end 26*a* of the pins 26 against the machine housing 12. The tank channel 22 is sealed from the percussion piston's upper percussion space 30 by the slide valve 16. In this position an end seal between the slide valve 16 and the machine housing 12 is also achieved.

The pins 26 create a force towards the right on the slide valve 16, which provides an end seal against the machine housing 12 when the slide valve 16 is located in the right hand position as shown in FIG. 1. The signal pressure on the slide valve's transition surface 18 provides an end seal when the slide valve 16 is located in the left hand position, as shown in FIG. 2.

Figure 3:
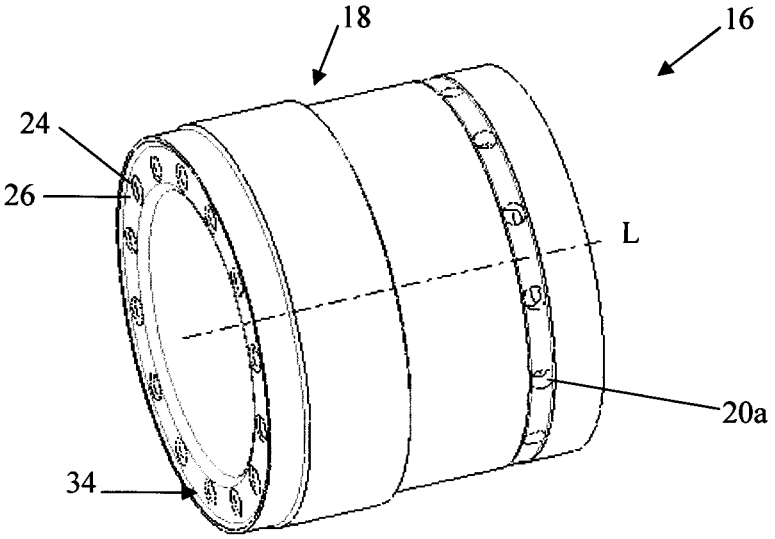
FIG. 3 shows a slide valve according to an embodiment of the present invention.

FIG. 3 shows a slide valve 16 according to an embodiment of the invention. The slide valve 16 comprises a transition surface 18, namely an edge where the outer diameter of the slide valve 16 changes from a larger diameter to a smaller diameter in the illustrated embodiment. The transition surface 18 is arranged to be alternately subjected to the percussion device's working pressure 20 and tank pressure 22 when the slide valve 16 is mounted in a percussion device 10. The slide valve 16 comprises a plurality of channels 24 uniformly distributed around the slide valve's 16 periphery, which channels 24 are open at one end 24*a*, and a number of pins 26 that are arranged inside the channels 24. The pins 26 are pressurized by being in fluid communication with pressurized hydraulic fluid, for example via conduits that connect the channels 24 with hydraulic fluid. The conduits (not shown) can be arranged to extend in the slide valve's radial direction when the slide valve 16 is mounted in a percussion device 10. FIG. 3 shows openings 20*a* that are in communication with the percussion device's working pressure 20. It should be noted that a pin 26 does not necessarily have to be arranged in each channel 26 of the slide valve.

Several modifications of the invention would be possible within the scope of the accompanying claims. For example, even though the illustrated embodiments show a plurality of separate channels 24, the slide valve 16 according to the present invention may comprise a plurality of connected channels, whereby all of the channels 24 are in fluid communication with a working pressure (for example the percussion device's working pressure 20 or a separate pressure source) via a single opening 20*a*. Alternatively, or additionally, a plurality of pins 26 may be arranged as a single component that is pressurized by hydraulic fluid or resilient material.

The invention claimed is:

1. Slide valve for a hydraulic percussion device, which slide valve comprises a transition surface that is arranged to alternately be subjected to a working pressure and a tank pressure to carry out a reciprocating movement when the percussion device is in use, wherein said slide valve is an annular member and comprises at least one channel which is open at one end of said slide valve, and at least one pin that is displaceable relative to said slide valve and that is at least partly arranged inside said at least one channel, whereby said at least one pin is arranged to be subjected to a working pressure that presses on one end surface of said at least one pin, the working pressure being introduced in said at least one channel between said end surface and a pressure surface opposite said end surface, whereby the other end surface of said at least one pin is pressed against a non-movable component of said hydraulic percussion device, which results in that said slide valve is pressed in the opposite direction to a direction in which said at least one pin is pressed.

2. Slide valve according to claim 1, wherein said working pressure is achieved using a hydraulic fluid.

3. Slide valve according to claim 1, wherein said at least one channel is in fluid communication with said hydraulic fluid via at least one conduit that is arranged to extend in said slide valve's radial direction when the slide valve is mounted in said hydraulic percussion device.

4. Slide valve according claim 1, wherein said slide valve is arranged to be displaced between two end locations when the percussion device is in use, and said at least one pin is arranged to press the slide valve against a non-moveable component of said hydraulic percussion device, such as the machine housing, to provide an end seal between said slide valve and said non-moveable component at both end locations.

5. Slide valve according to claim 1, wherein said working pressure is achieved with resilient material.

6. Slide valve according to claim 1, comprising a cylindrical sleeve.

7. Slide valve according to claim 1, having a plurality of different diameters.

8. Slide valve according to claim 1, wherein a surface of said slide valve is arranged to be subjected to tank pressure when the percussion device is in use.

9. Slide valve according to claim 1, wherein said at least one channel extends in said slide valve's axial direction when the slide valve is mounted in said hydraulic percussion device.

10. Slide valve according to claim 1, wherein said at least one channel extends along at least 20% of the slide valve's length.

11. Slide valve according to claim 1, including a plurality of channels and said plurality of channels is uniformly distributed around its periphery.

12. Slide valve according to claim 1, wherein the outer diameter of said at least one pin corresponds to the inner diameter of said at least one channel.

13. Slide valve according to claim 1, further comprising providing a seal between the non-movable component and the slide valve when the other end surface of said at least one pin is pressed against the non-movable component.

14. Method for making a slide valve of a percussion device to carry out a reciprocating movement when said percussion device is in use, which method comprises the step of alternately subjecting a transition surface of said slide valve to a working pressure and a tank pressure, wherein said slide valve is an annular member and is provided with at least one channel that is open at one end of said slide valve, and at least one pin that is displaceable relative to said slide valve and that is arranged at least partly inside said at least one channel, whereby said method comprises the step of subjecting said at least one pin to a working pressure that presses on one end surface of said at least one pin, said working pressure being introduced in said at least one channel between said end surface and a pressure surface opposite said end surface, whereby the other end surface of said at least one pin is pressed against a non-movable component of said hydraulic percussion device, which results in that said slide valve is pressed in the opposite direction to a direction in which said at least one pin is pressed.

15. Method according to claim 14, wherein said working pressure is achieved using a hydraulic fluid.

* * * * *